US007845979B2

(12) United States Patent
Eriksien

(10) Patent No.: US 7,845,979 B2
(45) Date of Patent: Dec. 7, 2010

(54) COAXIAL CONNECTOR AND METHOD FOR CONNECTING THE COAXIAL CONNECTOR TO A MATING COMPONENT

(75) Inventor: Kim Lunderen Eriksien, Vordingborg (DK)

(73) Assignee: John Mezzalingua Assoc., Inc., E. Syracuse, NY (US)

( * ) Notice: Subject to any disclaimer, the term of this patent is extended or adjusted under 35 U.S.C. 154(b) by 0 days.

(21) Appl. No.: 12/505,668

(22) Filed: Jul. 20, 2009

(65) Prior Publication Data

US 2010/0029131 A1 Feb. 4, 2010

(30) Foreign Application Priority Data

Aug. 1, 2008 (EP) ..... 08013821

(51) Int. Cl.
*H01R 9/05* (2006.01)

(52) U.S. Cl. ..... 439/578; 439/585

(58) Field of Classification Search ..... 439/462, 439/578, 583, 584, 585
See application file for complete search history.

(56) References Cited

U.S. PATENT DOCUMENTS 3,673,547 A 6/1972 Ziegler, Jr.
5,449,296 A 9/1995 Jacobsen et al.
5,586,910 A 12/1996 Del Negro et al.
5,651,698 A 7/1997 Locati et al.
5,927,892 A * 7/1999 Teh-Tsung ..... 403/259
6,592,403 B2 7/2003 Kooiman
7,078,623 B1 * 7/2006 Sheehan ..... 174/665
7,086,897 B2 8/2006 Montena
7,118,416 B2 10/2006 Montena
7,192,308 B2 * 3/2007 Rodrigues et al. ..... 439/578
7,504,582 B1 * 3/2009 Chiu ..... 174/650
2004/0132347 A1 7/2004 Souvay
2006/0154519 A1 7/2006 Montena
2006/0216990 A1 9/2006 Montena
2006/0292926 A1 12/2006 Chee et al.

* cited by examiner

*Primary Examiner*—Thanh-Tam T Le
(74) *Attorney, Agent, or Firm*—Melissa Bitting

(57) ABSTRACT

A coaxial connector comprises a swivel member defining a central axis and having first and second opposing ends. The first end having an outer and an inner surface and a threaded region for threadingly engaging the first end of the swivel member with a matching threaded portion of a mating component. A main body having first and second opposing body ends and a central bore defining a longitudinal axis which is coaxial with the central axis of the swivel member. The first body end having an outer cylindrical surface, a centre conductor extending along the longitudinal axis and a nut having a central aperture defining an inner surface and first and second opposing side walls. The first side wall being adapted to slidingly engage and abut the mating component and an inner inclining surface region.

15 Claims, 4 Drawing Sheets

COAXIAL CONNECTOR AND METHOD FOR CONNECTING THE COAXIAL CONNECTOR TO A MATING COMPONENT

FIELD OF THE INVENTION

The present invention relates to a coaxial connector for connecting a coaxial member to a mating component, an assembly method for assembling a coaxial connector, and a method for connecting the coaxial connector mounted on a cable to a mating component.

BACKGROUND OF THE INVENTION

When connecting a cable, e.g. a coaxial cable, to e.g. a distributor box or amplifier, it is important that the connection is secure and that there is no risk that it will loosen over time. Depending on the actual location of the connection, it could be subjected to various conditions such as moist, rain, tremor in the ground, changes in temperature, and the like. If the connector is not sufficiently protected against such conditions, the quality of the connection between the connector and e.g. a distributor box will suffer consequently. Furthermore, the quality of the physical connection is an indication of the shielding against electromagnetic radiation achieved by the connector.

From U.S. Pat. No. 6,592,403, a coaxial connector with a swivel interface is known. However, during the mounting of this interface, the interior parts of one part are twisted in relation to each other, and damage to the coaxial cable is therefore likely to occur. The interior and the exterior parts themselves are only secured against the entry of water by sealing rings, and imperfections during the manufacturing process of the components or simple wear and tear of the sealing rings could therefore cause water to penetrate the interior of the coaxial connector.

SUMMARY OF THE INVENTION

A first aspect of the present invention is, at least partly, to overcome the disadvantages of the prior art mentioned above, and to provide a coaxial connecter which can be connected to a mating component without essentially rotating the coaxial cable or the centre conductor.

An second aspect of the present invention is, at least partly, to overcome the disadvantages of the prior art mentioned above, and to provide an improved coaxial connector which is shielding better against electromagnetic radiation than other coaxial connectors having a swivel member.

A third aspect of the present invention is, at least partly, to overcome the disadvantages of the prior art mentioned above, and to provide an improved coaxial connector which is simple in its construction.

These aspects and the advantages becoming evident from the description below are obtained by a coaxial connector for connecting a coaxial member to a mating component, comprising: a swivel member defining a central axis and having first and second opposing ends, the first end having an outer and an inner surface and a threaded region for threadingly engaging the first end of the swivel member with a matching threaded portion of the mating component; a main body having first and second opposing body ends and a central bore defining a longitudinal axis which is coaxial with the central axis of the swivel member, the first body end having an outer cylindrical surface; a centre conductor extending along the longitudinal axis; and, a nut having a central aperture defining an inner surface and first and second opposing side walls, the first side wall being adapted to slidingly engage and abut the mating component, and an inner inclining surface region, wherein the swivel member extends through the central aperture of the nut, the inner surface of the nut engaging with the outer surface of the swivel member to prevent substantial rotation of the nut in relation to the swivel member, wherein the swivel member is rotatably received on the outer cylindrical surface of the first body end of the main body and the outer cylindrical surface is adjacent to a recessed region so as to form a shoulder, and wherein the second end of the swivel member has an inwardly extending projection and an outer inclining surface region and is radially compressible, the inner inclining surface region of the nut being adapted to cooperate with the outer inclining surface region of the swivel member so as to radially compress the second end of the swivel member in order to bring the inwardly extending projection into engagement with the shoulder.

In this way, it is achieved that the main body of the coaxial connector can be manufactured in one piece, thus minimising the risk of moist, dirt, and/or water penetrating to the inside of the main body. Furthermore, during installation of the coaxial connector to a mating component, only the nut and the swivel member is turned and the main body as well as the cable is kept still. Thus, damage to the cable and the centre conductor is avoided.

In one embodiment, the second end of the swivel member comprises at least one slit in order to allow the second end of the swivel member to be compressed. The at least one slit facilitates compression of the second end of the swivel member. In this way, the second end can be compressed so as to achieve a tight connection to the main body. The at least one slit could be obtained e.g. by cutting or milling or, if the swivel member is moulded, it could be obtained in the moulding process.

Moreover, a part of the outer surface of the second end of the swivel member may have a conical outline. A conical outline of the outer surface of the second end of the swivel member facilitates that when subjecting a force on the outer surface the resulting force will be in an angle relative to the incline of the conical outline. Thus, it is possible to subject a load on the outer surface e.g. parallel to the longitudinal axis of the coaxial connector and, due to the conical outline of the outer surface, the resulting force from the load will be directed to be essentially perpendicular to the longitudinal axis of the coaxial connector.

In addition, the at least one slit of the second end of the swivel member may extend through the surface having a conical outline. In this way, it requires less force to compress the second end of the swivel member. When compressing the second end of the swivel member, the slits will be minimised whereby shielding is increased.

Furthermore, the outer surface of the second end of the swivel member may comprise an area having opposing flats for receiving the inner surface of the nut. Due to the opposing flats, the nut can get such a firm grip of the swivel member so as to transfer a torque applied to the nut to the swivel member.

In one embodiment, the at least one slit of the second end of the swivel member extends through the area having opposing flats. In this way, it is possible to adjust the flexibility of the second end of the swivel member even further. If the swivel members are made of a relatively stiff material, it may be necessary to let the slits extend through the area having opposing flats.

Moreover, the swivel member may comprise an area on the outer surface that is adapted to carry a sealing member. In its mounted position, the sealing member will thus prevent moist and dirt from entering between the swivel member and the mating component.

Also, the area on the outer surface of the swivel member adapted to carry a sealing member can be placed between the threaded region of the swivel member and the outer area of the swivel member having opposing flats. In this way, it is achieved that electromagnetic radiation is hindered from spreading through the at least one slit in the second end of the swivel member. Furthermore, the sealing member prevents the nut from sliding off the swivel member.

In addition, the coaxial connector may further comprise at least one sealing member placed in a slot in the main body. This also helps to prevent electromagnetic radiation, moist, and dirt from passing between the swivel member and the main body.

The connector may further comprise a sealing member for sealing the space between the mating component and the swivel member. The sealing member serves to shield the surroundings from electromagnetic radiation. Furthermore, in its mounted position, the sealing member will also prevent moist and dirt from entering between the swivel member and the mating component.

In one embodiment, the sealing member may be a sealing ring.

In addition, the coaxial connector may be made substantially of a conductive material. The conductive material may be e.g. brass or plated brass. Brass provides good conductive abilities, which is preferred for coaxial connectors. Especially when the coaxial connector is used at outside locations, plated brass results in an increased sustainability.

Moreover, the outer surface of the second end of the swivel member comprising a conical-shaped area can be forced essentially radially towards the centre axis of the main body when a longitudinal force is subjected to the nut. A longitudinal force will be subjected to the nut when the coaxial connector is in its installed position. During tightening of the nut, an increasing force will be subjected from the nut to the conically-shaped area, thus gradually compressing the second end, i.e. the compressible end, of the swivel member more.

Furthermore, in an uncompressed state, the diameter of the second end of the swivel member and thereby the inwardly extending projection may have a larger diameter than in its compressed state.

In the compressed state, the inwardly extending projection of the second end of the swivel member may extend towards the centre axis of the main body in a smaller diameter than an outer diameter of the shoulder of the main body, thereby locking the swivel member to the main body. The inwardly extending projection serves to provide a firm and tight connection between the swivel member and the main body in the installed position of the coaxial connector. Furthermore, the inwardly extending projection may prevent the swivel member from sliding off the main body in the uninstalled position of the coaxial connector.

In one embodiment, the swivel member may be made of a flexible material able to expand when the inwardly extending projection is slid past the shoulder, and to subtract when the projection has been slid past the shoulder. In this way, it is automatically achieved that the swivel member engages with the main body when the swivel member is slid onto the main body in such way that the inwardly extending projection has passed the shoulder of the main body. Workers connecting the coaxial connector to e.g. an amplifier have the opportunity to assemble the connectors on-site if the situation so demands, e.g. due to a damaged swivel member.

In yet another embodiment a coaxial cable connector for coupling an end of a coaxial cable may comprise: a connector body having a first end and a second end, the connector body extending along a longitudinal axis, the connector body having an annular outer engagement portion at the fist end; a front member having a front member internal passageway defined therein, the front member having a first member end and a second member end, the front member comprising: a radially compressible annular retaining surface at the second member end; and, an outer retaining surface at the second member end, wherein engagement of the first end of the connector body into the front member internal passageway causes the annular outer engagement portion of the connector body to rotatably lock the radially compressible annular retaining portion of the front member for rotation on the connector body; and, a nut having a nut internal passageway defined therein, the nut internal passageway having an inner engagement portion, whereby insertion of the front member into the nut internal passageway causes the outer retaining surface of the front member to non-rotatably engage the inner engagement portion.

In addition, the invention relates to a method for assembling a coaxial connector, the method comprising the steps of: mounting the at least one sealing ring in a slot of main body; aligning the central axis of the swivel member and the main body and sliding the swivel member onto the first body end of the main body; sliding the inwardly extending projection of the swivel member past the shoulder of the outer cylindrical surface of the main body; aligning the central axis of the swivel member and the aperture of the nut and sliding the nut onto the outer cylindrical surface of the swivel member; and, mounting a second sealing member onto the area of the swivel member.

This assembly method is a cheap and failsafe way of assembling the coaxial connector. The simple build-up of the coaxial connector facilitates that a worker can replace a damaged swivel member without the use of special tools.

Finally, the invention also relates to a method for connecting the coaxial connector mounted on a cable to a mating component, the method comprising the steps of: mounting the coaxial connector on the end of a cable; placing the threaded part of the mounted swivel member in contact with a mating component; applying a torque to the nut and thereby rotating the swivel member in relation to the main body thereby drawing the coaxial connector and the mating component towards each other; and, when the mating component and the first side wall of the nut are in contact, tightening the nut and thereby drawing the swivel member further into the mating component in relation to the nut in order to displace the nut towards the second end of the swivel along the centre axis and thereby applying compression to the compressible second end of the swivel member in order to move the projection behind the shoulder of the main body radially towards the centre axis of the main body, thereby engaging the swivel member with the main body.

When connecting the coaxial connector of the present invention with a mating component, e.g. an amplifier, the workers need only to turn one nut in order to achieve a firm connection. The force of the torque applied on the nut will automatically be redirected to the force necessary to tightly connect the mating component and the coaxial connector.

Thus, it is not necessary to have a check nut. By avoiding the check nut, a faster and simpler connection process is achieved.

DESCRIPTION OF THE PREFERRED EMBODIMENT(S)

Figure 1:
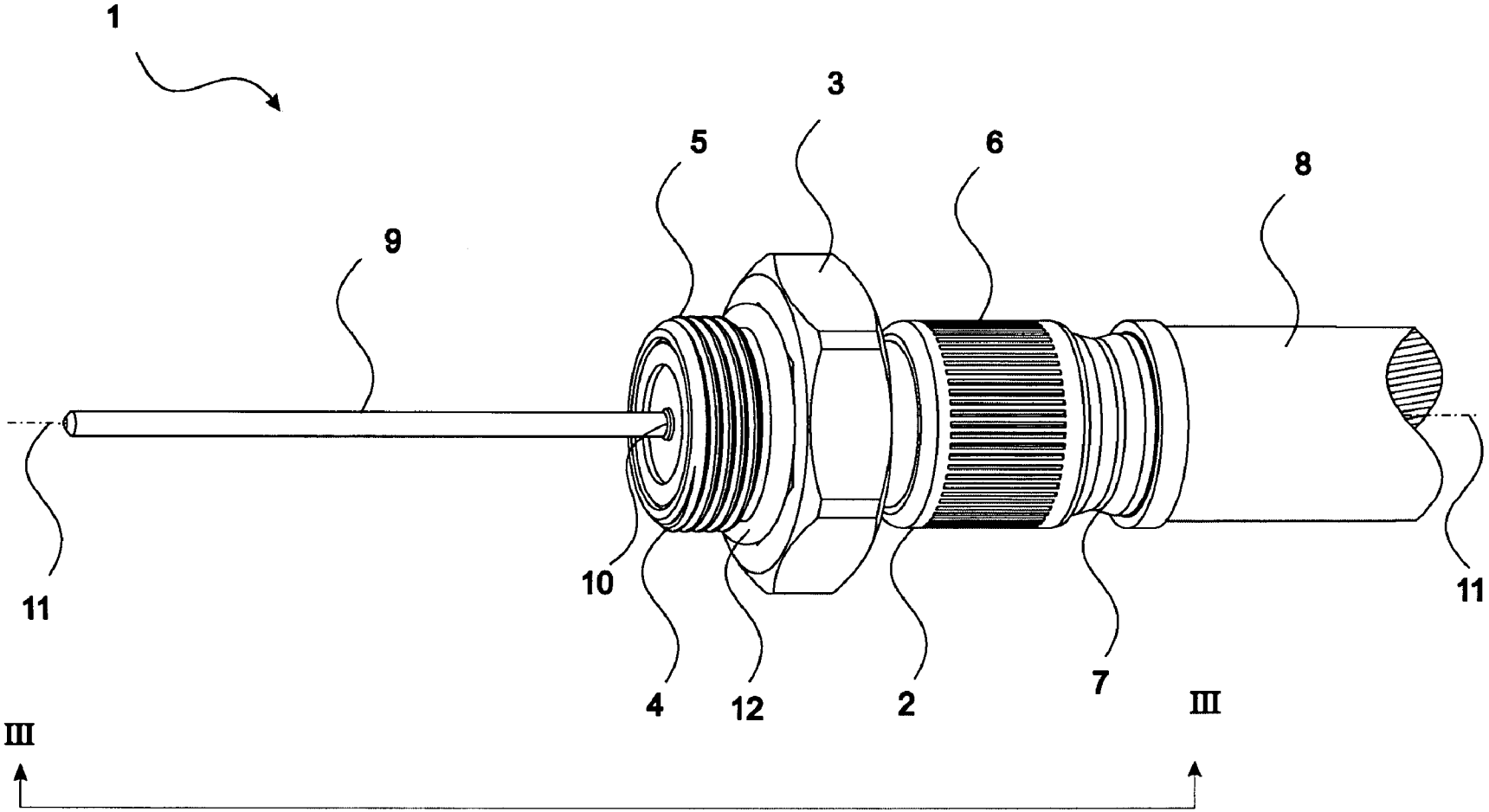
FIG. 1 shows a coaxial connector according to the invention.

In FIG. 1, a coaxial connector 1 according to the invention is shown. The coaxial connector 1 comprises a main body 2, a nut 3, and a swivel member 4 (only a threaded region 5 of the swivel member 4 is visible). A second body end 6 of the main body 2 is equipped with clamping means 7 adapted to connect a coaxial cable 8 to the main body 2. This connection between the coaxial cable 8 and the main body 2 could be facilitated in various ways, e.g. by clamping, moulding, or the like. A centre conductor 9 extends from the centre 10 of the main body 2 along a longitudinal axis 11 of the main body 2. Furthermore, a first sealing ring 12 is positioned between the threaded region 5 and the nut 3. The main body 2, the nut 3, and the swivel member 4 may be made of brass or plated brass. However, various conductive materials could be used, such as plastic/metal composites, gold, aluminium, and the like.

Figure 2:
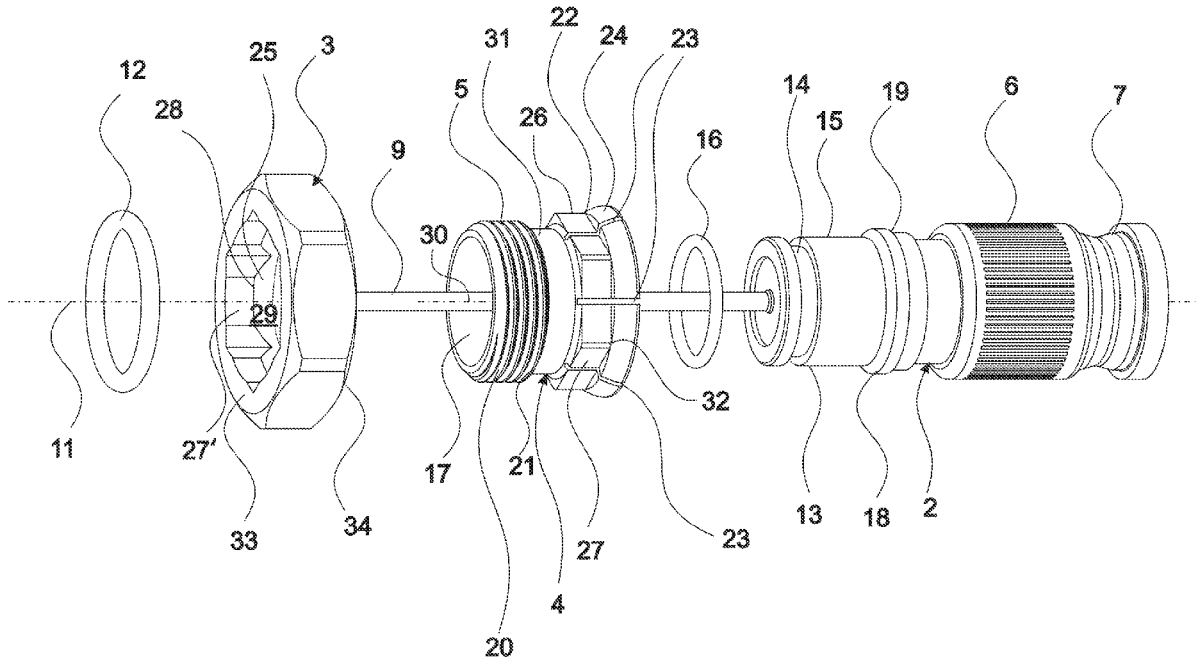
FIG. 2 shows and exploded view of the coaxial connector of FIG. 1.

FIG. 2 shows an exploded view of the coaxial connector 1 of FIG. 1. The cable 8 is not shown. The build-up of the coaxial connector 1 is shown (none of the interior parts in the main body 2 are shown). The main body 2 comprises a first body end 13 and a second body end 6.

The first body end 13 of the main body 2 has a slot 14 in an outer cylindrical surface 15 of the first body end 13. The slot 14 is adapted for receiving a second sealing ring 16. The second sealing ring 16 provides a tight connection between an inner surface 17 of the swivel member 4 and the first body end 13 of the main body 2. The swivel member 4 is assembled with the main body 2 by sliding it on the first body end 13 of the main body 2. Furthermore, the cylindrical outer surface 15 of the first body end 13 is placed adjacent to a recessed region 18 so as to provide a shoulder 19.

The swivel member 4 comprises a first end 20 having an inner surface 17 and an outer surface 21. In this embodiment, the outer surface 21 of the first end 20 of the swivel member 4 is a threaded region 5. The outer surface 21 could comprise other kinds of connection means depending on the mating component to which the swivel member 4 is to be connected. The second end 22 of the swivel member 4 is radially compressible due to slits 23 and provided with an inwardly extending projection (not visible) and an outer conical region 24. The outer conical region 24 is adapted to cooperate with an inner inclining surface region 25 of the nut 3 so as to radially compress the compressible second end 22 of the swivel member 4 in order to bring the inwardly extending projection (not visible) into further engagement with the shoulder 19 of the first body end 13 of the main body 2. The second end 22 of the swivel member 4, i.e. the compressible second end 22, further comprises a region 26 having opposing flats 27 for at least partly receiving an inner surface 28 of the nut 3. The nut 3 is assembled with the swivel member 4 in such a way that the central aperture 29 of the nut 3 is coaxial with the central axis 30 of the swivel member 4, this being concentric with centre 10 of the main body 2. The inner surface 28 of the nut 3 has flats 27' corresponding to the flats of the region 26 of the swivel member 4 having opposing flats 27. In this way, it is achieved that the swivel member 4 and the nut 3 can move relative to each other along the longitudinal axis 11 of the main body 2. The slits 23 of the swivel member 4 can be manufactured in various ways, e.g. milling, directly in a moulding process, by sawing, or the like.

In this embodiment of the coaxial connector 1, the swivel member 4 comprises flats 27 and the nut 3 comprises flats 27' in order to achieve that the swivel member 4 and the nut 3 is rotated along with each other. However, this effect could be obtained in other ways, e.g. by a key and slot connection or the like. Between the region 26 with flats 27 and the threaded region 5 of the swivel member 4, an area 31 is situated, adapted to receive a first sealing member, e.g. a first sealing ring 12. When the nut 3 is mounted on the swivel member 4, the first sealing ring 12 is placed in the. area 31 serving to keep the nut 3 from sliding off. Furthermore, the first sealing ring 12 serves to provide a seal between a mating component (not shown) and the swivel member 4. The outer inclining surface region 24 is annular, although cut by slits 23. As can be seen, the slits 23 traverse through the outer inclining surface region 24 and the region 26 having flats 27. Due to the slits 23, the second end 22 of the swivel member 4 is compressible, because the slits 23 results in a number of flexible fingers 32 in the second end 22, thus making the second end 22 compressible. During mounting of the swivel member 4 on the main body 2, the flexibility of the fingers 32 enables the inwardly extending projection (not shown) to pass the recessed region 18 of the first end 13 of the main body 2. The inwardly extending projection (not shown) will, when the swivel member is in its mounted position, be placed in such manner that the swivel member 4 cannot be slid off because the inwardly extending projection (not shown) is engaged with the shoulder 19 of the main body 2.

Thus, the nut 3 having a central aperture 29 defining an inner surface 28 at least partly comprising flats 27' is able to receive the swivel member 4 through the central aperture 29, the swivel member 4 thus extending through the central aperture 29. When the inner surface 28 with its opposing flats 27' of the nut 3 is engaging the external surface of the swivel member 4, the region 26 with opposing similar flats 27 of the swivel member 4 will rotate with the nut 3. The nut 3 includes a first and a second opposing side wall 33, 34, the first side wall 33 being adapted to slidingly engage and abut a mating component (not shown).

Figure 3:
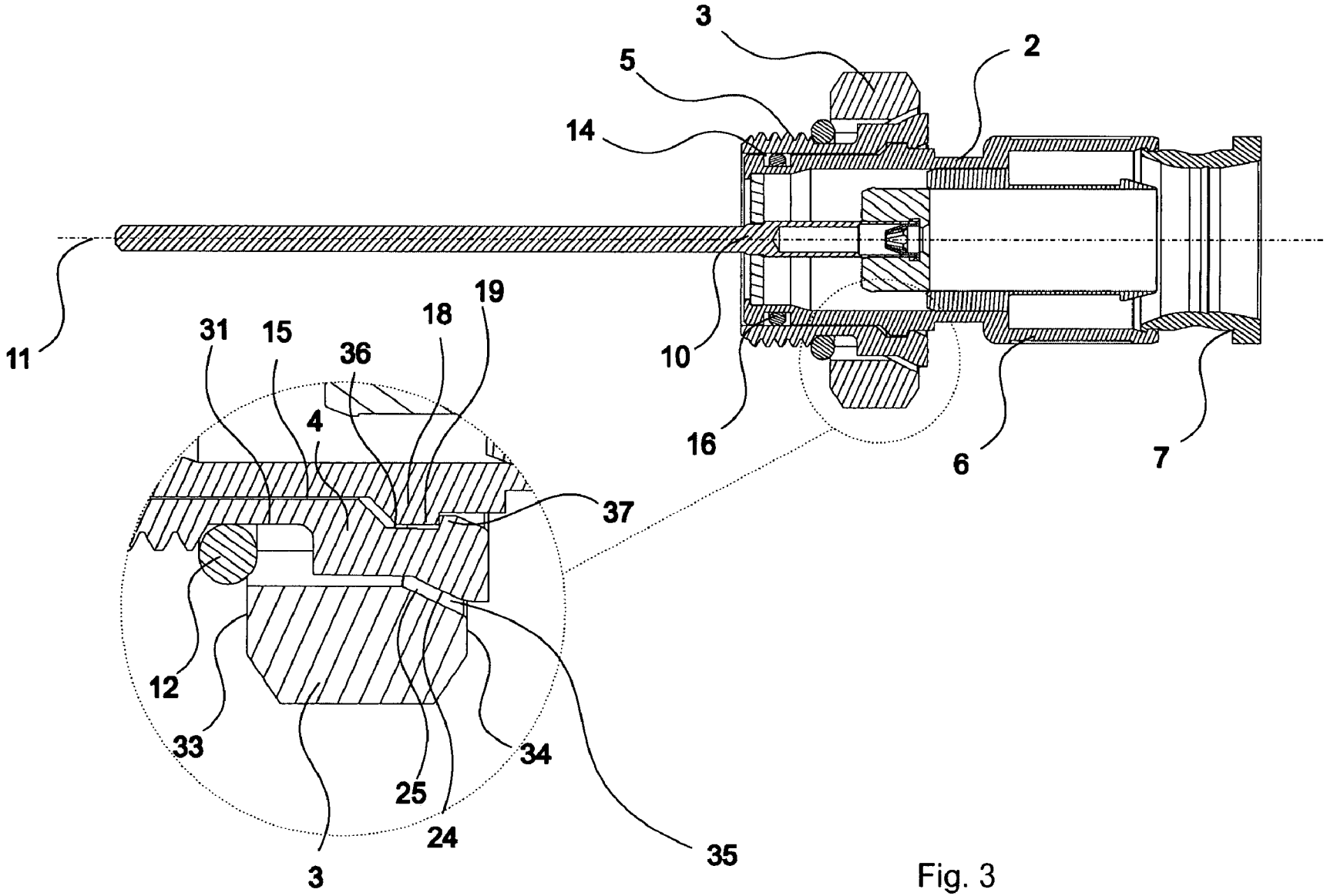
FIG. 3 is a section view along the line III-III of the coaxial connector assembly of FIG. 1

FIG. 3 shows a sectional view of the coaxial connector 1 of FIG. 1. The coaxial connector 1 is shown in an assembled state, but not connected to a mating component. Encircled by a dotted line an enlarged view of the position of the main body 2, the nut 3 and the swivel member 4 in relation to each other is shown in uncompressed state i.e. when the coaxial connector 1 is not mounted to a mating component (not shown). In this state, it is seen that a first play 35 is present between the outer conical region 24 of the swivel member 4 and the inner inclining surface region 25 of the nut 3. A second play 36 is seen between the recessed region 18 of outer cylindrical surface 15 and a part of the inner surface of the compressible second end 22 of the swivel member 4. Furthermore, it is seen that an inwardly extending projection 37 of the swivel member 4 is positioned in such a manner that the swivel member 4 cannot slide off the main body 2. This results in the fact that, when the threaded region 5 of the swivel member 4 is connected to a mating component (not shown) and the nut 3 is turned in order to draw the swivel member 4 into the mating component, the first side wall 25 will be brought into contact with the mating component. In relation to the mating component, the nut 3 will be in a fixed position when it is in contact with the mating component. As a consequence, the swivel member 4 will slide towards the mating component, i.e. away from the second end 6 of the main body 2, and the swivel member 4 will thus slide relative to the nut 3 along the longitudinal axis of the main body 2. This relative movement of the swivel member 4 and the nut 3 will cause the outer inclining surface region 24 of compressible second end 22 of the swivel member 4 to get in contact with the inner inclining surface region 25 of the nut 3. The inclination of the inclining regions 24, 25 will have a resulting force that will press the inwardly extending projection 37 radially towards the longitudinal axis 11 of the main body 2. The compressibility of the second end 22 of the swivel member 4 facilitates that only a small torque is to be applied to the nut 3 in order to achieve a firm connection between the coaxial connector 1 and the mating component.

Figure 4:
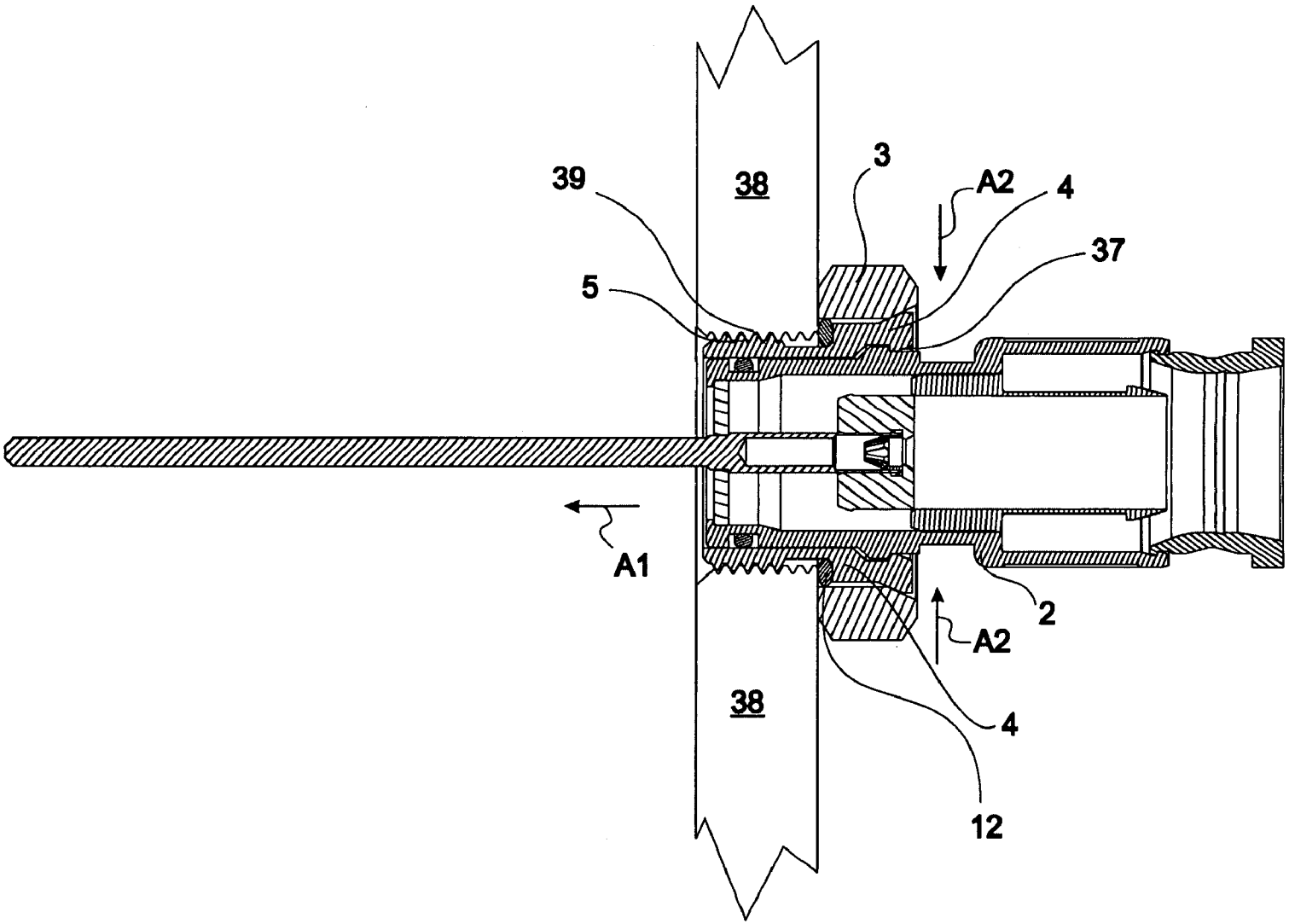
FIG. 4 is a section view of the coaxial connector mounted to a mating component, i.e, in its compressed state.

FIG. 4 shows a sectional view similar to that of FIG. 3, in this case in the situation where the coaxial connector 1 is connected to a mating component 38. The mating component 38 could be a part of e.g. an amplifier or the like. In this case, the mating component 38 is provided with a thread 39 into which the threaded region 5 of the swivel member 4 is engaged. When the swivel member 4 is engaged with the thread 39 of the mating component 38 and the nut 3 is turned, the swivel member 4 will be turned accordingly and thus drawn in the direction of the arrow A1. The inwardly extending projection 37 engaged with the shoulder 19 causes the main body 2 to be drawn along with the swivel member 4 in the direction of the arrow A1. As the first side 33 of the nut 3 comes into contact with the mating component 38, the inner inclined surface region 25 of the nut 3 will apply a force to the outer conical region 24 of the swivel member 4. In this way, the fingers 32 and thus the inwardly extending projection 37 will be forced radially towards the centre of the swivel member 4, i.e. following the direction of the arrows A2. Due to the fact that the swivel member 4 is annular, the arrows A2 in this two-dimensional cross sectional drawing point towards each other. Furthermore, it can be seen that the first sealing ring 12 is compressed, thus ensuring an efficient tightening between the mating component 38 and the swivel member 4. The spring power of the compressible second end 22 of the swivel member 4 provides sufficient power to keep the coaxial connector 1 in place without the necessity of a locking nut.

The connection of the coaxial connector 1 to a mating component 38 is carried out without the main body 2 of the coaxial connector 1 being twisted, and the risk of damaging both the centre conductor 9 and the cable 8 (not shown) is thus minimized.

The build-up of the outer surface of the second end 22, i.e. the compressible end, of the swivel member 4 may vary. The second end 22 may have integrated flats 27 with an inclining outer surface. In such an embodiment, the second end 22 of the swivel member 4 would be pyramid-shaped. The inner inclining surface 28 of the nut 3 would then be adapted correspondingly in order to achieve the same effect as described above. For the person skilled in the art, various shapes of the second end 22 of the swivel member 4, and thus various shapes of the corresponding inner surface of the nut, could be considered suitable.

The coaxial cable connector 1 for coupling an end of a coaxial cable may comprise a connector body 2 having a first end 13 and a second end 6. The connector body 2 extends along a longitudinal axis and has an annular outer engagement portion 19 at the first end 13. The coaxial cable connector 1 for coupling an end of a coaxial cable may comprise a front member 4 having a front member internal passageway 3 defined therein. The front member 4 has a first member end 20 and a second member end 22 and comprises a radially compressible annular retaining surface 37 at the second member end 22. Further, the front member 4 comprises an outer retaining surface 24 at the second member end 22, wherein engagement of the first end 13 of the connector body 2 into the front member internal passageway 30 causes the annular outer engagement portion 19 of the connector body 2 to rotatably lock the radially compressible annular retaining portion 37 of the front member 4 for rotation on the connector body 2. In addition the front member 4 comprises a nut 3 having a nut internal passageway 29 defined therein. The nut internal passageway 29 has an inner engagement portion 25, whereby insertion of the front member 4 into the nut internal passageway 29 causes the outer retaining surface 24 of the front member 4 to non-rotatably engage the inner engagement portion 25.

A connector body may be equal to main body. An annular outer engagement portion may be a shoulder. A front member may be equal to a swivel member. A front member internal passageway may be equal to a central aperture. A radially compressible annular retaining surface may be equal to an inwardly extending projection. A nut internal passageway may be equal to the central aperture. An inner engagement portion is equal to an inner inclining surface region of the nut. An outer retaining surface may be an outer inclining surface region.

I claim:

1. A coaxial connector for connecting a coaxial member to a mating component, comprising:

a swivel member defining a central axis and having first and second opposing ends, the first end having an outer and an inner surface and a threaded region for threadingly engaging the first end of the swivel member with a matching threaded portion of the mating component;

a main body having first and second opposing body ends and a central bore defining a longitudinal axis which is coaxial with the central axis of the swivel member, the first body end having an outer cylindrical surface;

a centre conductor extending along the longitudinal axis and, a nut having a central aperture defining an inner surface and first and second opposing side walls, the first side wall being adapted to slidingly engage and abut the mating component , and an inner inclining surface region, wherein the swivel member extends through the central aperture of the nut, the inner surface of the nut engaging with a region of the swivel member to prevent substantial rotation of the nut in relation to the swivel member, wherein the swivel member is rotatably received on the outer cylindrical surface of the first body end of the main body and the outer cylindrical surface is adjacent to a recessed region so as to form a shoulder, and wherein the second end of the swivel member has an inwardly extending projection and an outer inclining surface region and is radially compressible, the inner inclining surface region of the nut being adapted to cooperate with the outer inclining surface region of the swivel member so as to radially compress the second end of the swivel member in order to bring the inwardly extending projection into engagement with the shoulder.

2. A coaxial cable connector according to claim 1, wherein the second end of the swivel member comprises at least one slit in order to allow the second end of the swivel member to be compressed.

3. The coaxial cable connector according to claim 2, wherein a part of the outer surface of the second end of the swivel member has a conical outline.

4. A coaxial connector according to claim 3, wherein the at least one slit of the second end of the swivel member extends through the surface having a conical outline.

5. A coaxial connector according to claim 4, wherein the outer surface of the second end of the swivel member comprises an area having opposing flats for receiving the inner surface of the nut.

6. A coaxial connector according to claim 5, wherein the at least one slit of the second end of the swivel member extends through an area having opposing flats.

7. A coaxial connector according to claim 6, wherein the swivel member comprises an area on the outer surface that is adapted to carry a first sealing member.

8. A coaxial connector according to claim 7, wherein the area on the outer surface of the swivel member adapted to carry the first sealing member is placed between the threaded region of the swivel member and the region of the swivel member having opposing flats.

9. A coaxial connector according to claim 8, wherein the coaxial connector further comprises a second sealing member placed in a slot in the main body.

10. A coaxial connector according to claim 1, wherein the coaxial connector is substantially made of a conductive material.

11. A coaxial connector according to claim 10, wherein the conductive material is brass or plated brass.

12. A coaxial connector according to claim 11, wherein the outer surface of the second end of the swivel member comprising a conical-shaped area is forced essentially radially towards the longitudinal axis of the main body when a longitudinal force is subjected to the nut.

13. A coaxial connector according to claim 12, wherein in an uncompressed state, the diameter of the second end of the swivel member and thereby the inwardly extending projection has a larger diameter than in its compressed state.

14. A coaxial connector according to claim 13, wherein in the compressed state, the inwardly extending projection of the second end of the swivel member extends toward the longitudinal axis of the main body in a smaller diameter than an outer diameter of the shoulder of the main body, thereby locking the swivel member to the main body.

15. A coaxial connector according to claim 14, wherein the swivel member is made of a flexible material able to expand when the inwardly extending projection is slid past the shoulder, and to subtract when the inwardly extending projection has been slid past the shoulder.

* * * * *